US007419235B2

(12) United States Patent
Kitakami

(10) Patent No.: US 7,419,235 B2
(45) Date of Patent: Sep. 2, 2008

(54) LIQUID EJECTING METHOD AND APPARATUS THEREFOR

(75) Inventor: Koichi Kitakami, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 353 days.

(21) Appl. No.: 11/007,295

(22) Filed: Dec. 9, 2004

(65) Prior Publication Data

US 2005/0156977 A1 Jul. 21, 2005

(30) Foreign Application Priority Data

Dec. 15, 2003 (JP) ..... 2003-415868

(51) Int. Cl.
*B41J 29/38* (2006.01)

(52) U.S. Cl. ..... 347/14; 347/6

(58) Field of Classification Search ..... 347/14, 347/19, 6

See application file for complete search history.

(56) References Cited

U.S. PATENT DOCUMENTS

| | | | |
|---|---|---|---|
| 5,371,520 | A | 12/1994 | Kubota |
| 5,521,619 | A | 5/1996 | Suzuki et al. |
| 6,312,077 | B1 | 11/2001 | Araki |
| 2003/0122889 | A1 | 7/2003 | Okuda |

FOREIGN PATENT DOCUMENTS

| | | |
|---|---|---|
| EP | 1 004 441 | 5/2000 |
| EP | 1 177 896 | 2/2002 |
| JP | 2000-158651 | 6/2000 |

OTHER PUBLICATIONS

Korean Office Action, issued Feb. 8, 2007, in Korean Patent Application No. 10-2004-0105216.

European Office Action, issued Jan. 25, 2007, in European Patent Application No. 04 257 761.9.

*Primary Examiner*—Matthew Luu
*Assistant Examiner*—Lisa M Solomon
(74) *Attorney, Agent, or Firm*—Fitzpatrick, Cella, Harper & Scinto

(57) ABSTRACT

A liquid ejecting method can eject liquid from a liquid ejecting head, the liquid ejecting head including a liquid chamber for storing liquid to be ejected, an ejection outlet in fluid communication with the liquid chamber, a liquid chamber volume controller for changing a volume of the liquid chamber, and an outer surface through which the ejection outlet is open. The method includes, in each ejection period in which the liquid is ejected through the ejection outlet, a first expansion step of expanding a volume of the liquid chamber; a first contraction step of reducing the volume of the liquid chamber after the first expansion step; a second expansion step of expanding, after start of the contraction step, the volume of the liquid chamber before a leading end of a column of the liquid projects outside beyond the outer surface.

6 Claims, 6 Drawing Sheets

LIQUID EJECTING METHOD AND APPARATUS THEREFOR

FIELD OF THE INVENTION AND RELATED ART

The present invention relates to a liquid ejecting method which is for a liquid ejecting apparatus comprising: a plurality of liquid ejection orifices, a plurality of liquid chambers connected to the plurality of liquid ejection orifices, one for one, and a plurality of liquid chamber volume controlling means which are integral parts of the plurality of liquid chambers, one for one, and which cause the liquid ejecting apparatus to eject liquid, by changing the volume of each liquid chamber by the liquid volume controlling means. The present invention also relates to a liquid ejecting apparatus compatible with such a liquid ejecting method. The liquid ejecting method and liquid ejecting apparatus in accordance with the present invention are applicable to various liquid ejecting apparatuses, for example, an ink jet recording apparatus, a device for printing on paper, fabric, leather, unwoven fabric, OHP, etc., a patterning apparatus or painting apparatus for adhering liquid to substrate, board, solid objects, etc., which are required to eject very minute liquid droplets while being highly accurate in terms of the location at which the liquid droplets land.

An ink jet recording apparatus has been widely used as the recording apparatus for a printer, a facsimile, etc., because it is low in noise, low in operational cost, small in size, and easily enabled to form color images. Further, in recent years, its usage has been spreading in the device manufacturing field, in which it is used as a patterning apparatus.

In the majority of ink jet recording apparatuses, the recording head is moved in the primary scanning direction while it is ejecting liquid droplets. It is possible, however, to structure an ink jet recording apparatus so that the recording head remains stationary while a recording medium is moved. It can be assumed that the above described structural arrangements are applicable to a patterning apparatus, a painting apparatus, etc.

For example, the ink jet recording apparatus disclosed in Patent Document 1 is provided with a liquid ejection head having a plurality of pressure generation chambers connected to a plurality of nozzles, one for one, and a plurality of piezoelectric elements for pressurizing the pressure generation chambers, one for one. It is structured so that it can repeatedly and rapidly form liquid droplets while stabilizing its recording head in terms of the meniscus position at the point of ejection by controlling the waveform of the voltage for compressing or decompressing the piezoelectric element with the use of a driver circuit.

Either way, as long as the recording head and recording medium are moved relative to each other at a high speed, a complex flow of air is generated through the gap (which hereinafter will be referred to as "recording gap") between the recording head and recording medium.

Observing in detail the process by which liquid was ejected through an ejection orifice revealed that ink was ejected through the following process, whether an ink jet recording apparatus was used as an ordinary recording apparatus or as a patterning apparatus. That is, first, an electrical signal was inputted. As the electrical signal was inputted, a vibration plate which constituted a part of a liquid chamber was vibrated to repeatedly expand and contract the liquid chamber, in order to control the volume of the liquid chamber. As the volume of the liquid chamber was controlled, liquid was extruded outward in the form of a column from the ejection orifice. Then, the column of liquid was severed from the body of the liquid in the ejection orifice, and flew through the recording gap while it was being broken into a plurality of liquid droplets by the surface tension.

As liquid began to be extruded, in the form of a column, from the liquid ejection orifice into the recording gap, it was subject to a complex flow of air in the recording gap. The speed at which a recording head and a recording medium are moved relative to each other has been continuously increased in order to reduce recording time or painting time. This trend of continuously increasing the recording or painting speed means further increase in speed of the air to which the liquid column is subjected in the recording gap.

Furthermore, a recording head has been continuously reduced in liquid droplet size. In other words, a recording head has been continuously reduced in liquid column size. In recent years, therefore, it has become likely that the liquid column will be easily tilted by the air flow in the recording gap relative to the line perpendicular to the surface of an orifice plate having the ejection orifices. The liquid droplets, yielded from a liquid column angled relative to the predetermined direction in which liquid is to be ejected, are different in the point at which their flight begins. Therefore, they are destined to be different in the landing point.

SUMMARY OF THE INVENTION

The primary object of the present invention is to provide a combination of a liquid ejecting method, and an apparatus compatible with the liquid ejecting method, which minimizes the effect of the air flow in the recording gap by reducing the length by which liquid is extruded in the form of a column from a liquid ejection head, so that minute liquid droplets are ejected at a high level of landing accuracy.

According to an aspect of the present invention, there is provided a liquid ejecting method for ejecting liquid from a liquid ejecting head, said liquid ejecting head including a liquid chamber for storing liquid to be ejected, an ejection outlet in fluid communication with the liquid chamber, liquid chamber volume control means for changing a volume of the liquid chamber, and an outer surface through which said ejection outlet is open, the improvement residing in that each ejection period in which the liquid is ejected through said ejection outlet including, a first expansion step of expanding a volume of said liquid chamber; a first contraction step of reducing the volume of said liquid chamber after said first expansion step; and a second expansion step of expanding, after start of said contraction step, the volume of said liquid chamber before a leading end of a column of the liquid project to outside beyond the outer surface.

It is preferable that the method further comprises an additional contraction step of reducing the volume of said liquid chamber to such an extent that liquid is not ejected.

According to another aspect of the present invention, there is provided a liquid ejecting apparatus including a liquid ejecting head, said liquid ejecting head including a liquid chamber for storing liquid to be ejected, an ejection outlet in fluid communication with the liquid chamber, liquid chamber volume controlling and changing means for changing a volume of the liquid chamber, and an outer surface through which said ejection outlet is open, said liquid ejecting apparatus comprising: a driving circuit for applying, to said liquid chamber volume controlling and changing means, a signal for, in an ejection period in which the liquid is ejected through said ejection outlet, expanding the volume of said liquid chamber, and then, reducing the volume of said liquid chamber, and expanding the volume of said liquid chamber before a leading end of a column of the liquid project to outside beyond the outer surface.

It is preferable that said liquid chamber volume controlling and changing means includes a piezoelectric element.

According to the combination of the liquid ejecting method and liquid ejecting apparatus in accordance with the present invention, the length of the time it takes for the body of liquid extruded from the liquid ejection head to break into a plurality of liquid droplets (spherical) can be reduced by minimizing the length, by which the body of liquid is extruded, in the form of a column, from the liquid ejection head, by severing the body of liquid having been extruded in the form of a column, from the body of liquid in the liquid ejection head, by pulling the body of liquid in the liquid ejection head in the direction opposite to the direction (outward direction) in which the body of liquid is being extruded in the form of a column. Therefore, the effect of the air flow in the recording gap upon the body of liquid being extruded in the form of a column is minimized, making it therefore possible to eject minute liquid droplets at a high level of landing accuracy.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the liquid ejecting method in accordance with the present invention, and ink jet recording apparatuses compatible with the liquid ejecting method.

Figure 1:
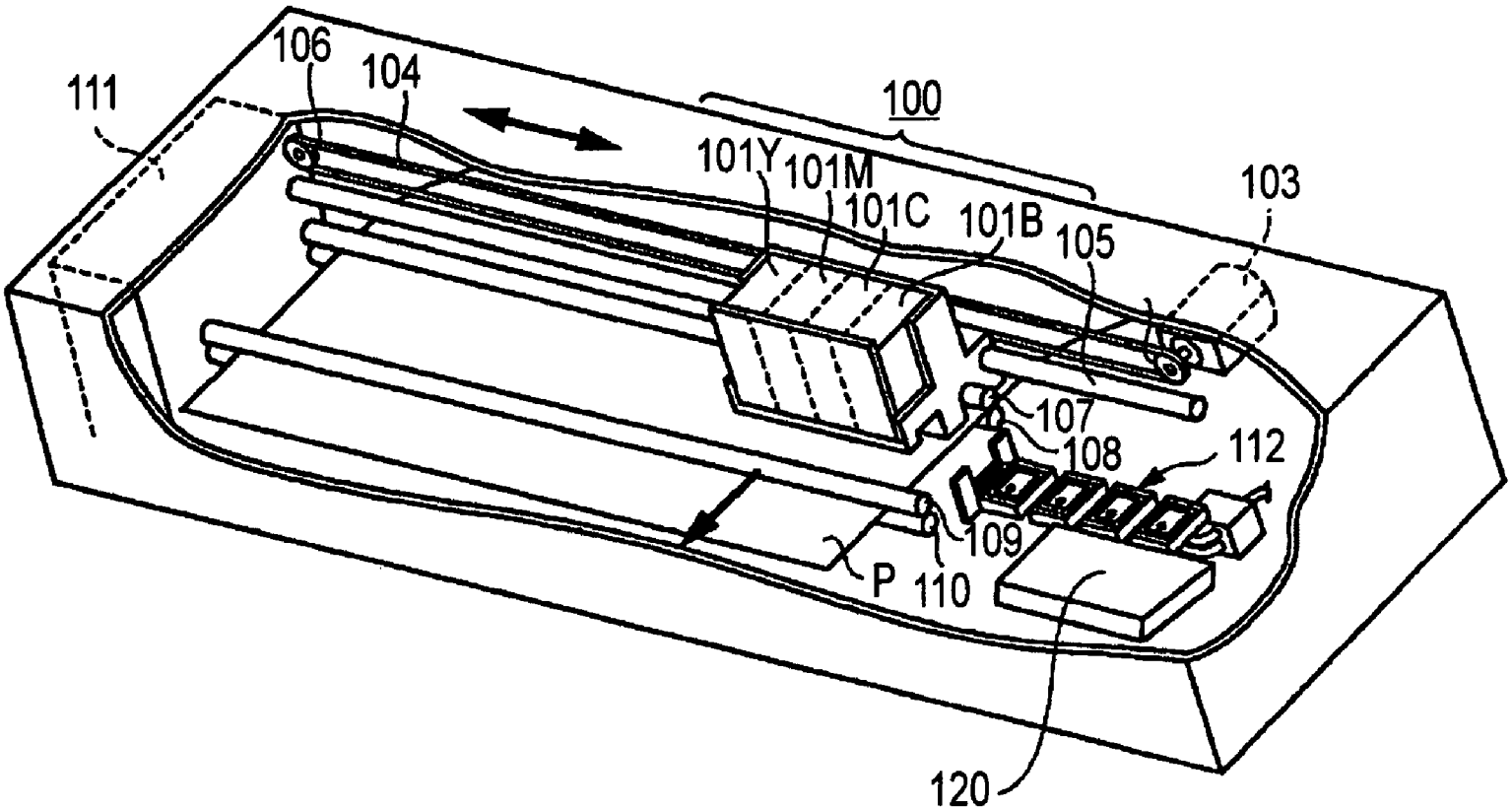
FIG. 1 is a schematic perspective view of the ink jet recording apparatus compatible with the liquid ejecting method in accordance with the present invention.

FIG. 1 is a schematic perspective view of a typical ink jet recording apparatus compatible with the present invention. As shown in FIG. 1, as a recording medium P is inserted into the ink jet recording apparatus, it is conveyed by a pair of conveying rollers 109 and 110 to the area in which recording can be made by the recording head unit 100. The recording head unit 100 is supported by a pair of guiding shafts 107 and 108, being enabled to be reciprocally moved along the guiding shafts 107 and 108 in the direction (primary scanning direction) parallel to the direction in which the guiding shafts 107 and 108 extend. The direction in which the recording head unit is reciprocally movable is the primary scanning direction, and the direction in which the recording medium P is conveyed is the secondary scanning direction. The recording head unit 100 has a plurality of recording heads for ejecting, in the form of a liquid droplet, a plurality of inks different in color, and a plurality of ink containers for supplying the recording heads with the plurality of inks different in color, one for one. The number of inks, different in color, ejected by the ink jet recording apparatus is four; the four inks are black (Bk), cyan (C), magenta (M), and yellow (Y) inks. The order in which the plurality of ink containers are arranged is optional.

There is a recovery unit 112 below the right end portion of the moving range of the recording head unit 100. The recovery unit 112 cleans the ejection orifices of the recording head to restore the performance of the recording head when the recording head is not in operation.

The recording head unit 100 and the black (Bk), cyan (C), magenta (M), yellow (Y) ink containers are structured so that the ink containers can be replaced independently from each other. In the recording head unit 100, a group of recording heads for ejecting Bk ink droplets, C ink droplets, M ink droplets, and Y ink droplets, one for one, an ink container 101B for Bk ink, an ink container 101C for C ink, an ink container 101M for M ink, and an ink container 101Y for Y ink, are mounted. The ink containers are connected to the corresponding ink jet recording heads, one for one, supplying thereby the inks into the ink passages (nozzles) leading to the ejection orifices of the group of recording heads. The structures of the recording head unit 100 and ink containers do not need to be limited to the above described structures. For example, the ink containers 101B, 101C, 101M, and 101Y may be integrated in optional combinations.

Figure 2:
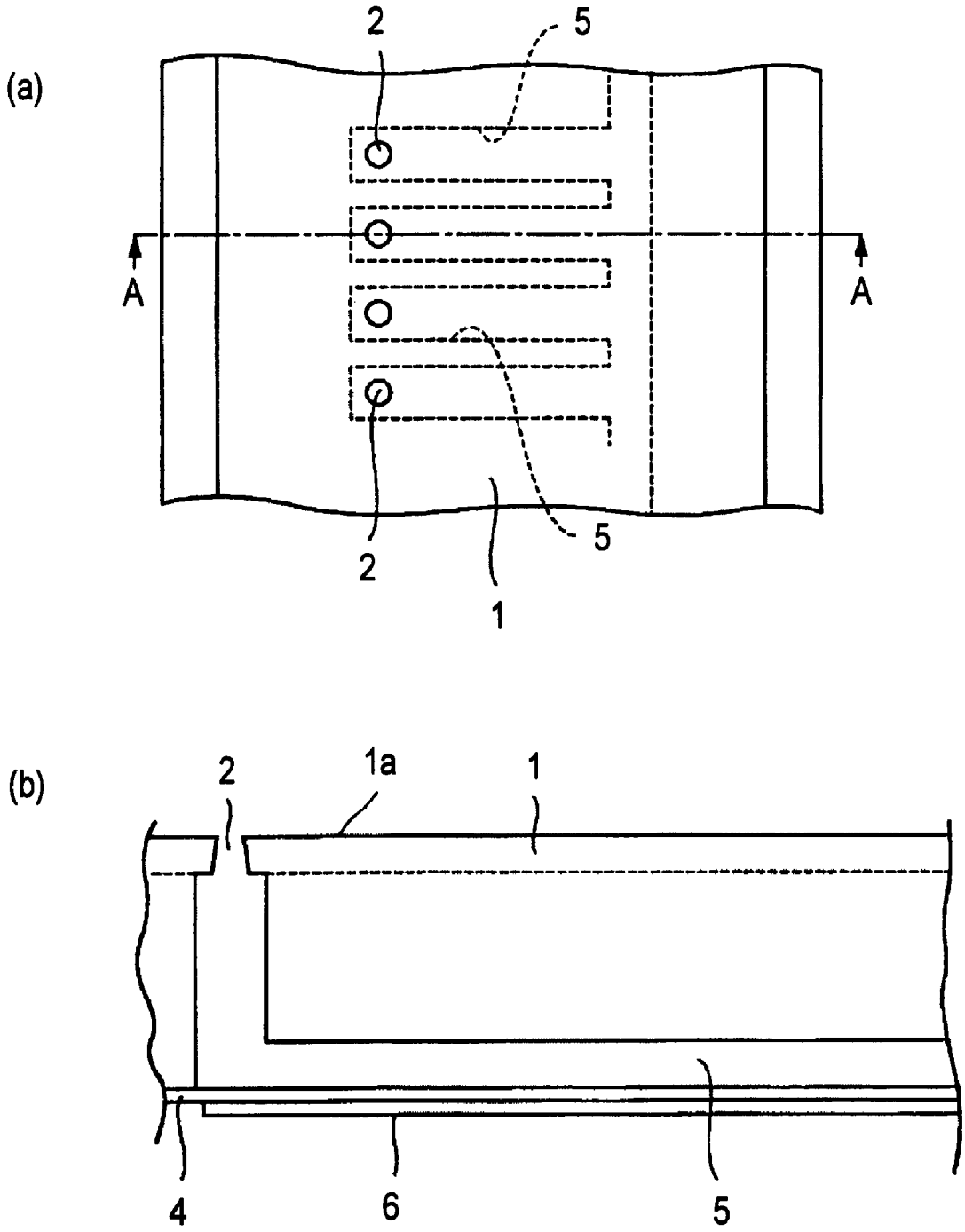
FIG. 2(*a*) is a schematic plan view of a part of the liquid ejection head compatible with the liquid ejecting method in accordance with the present invention, and FIG. 2(*b*) is a schematic sectional view of the portion of the liquid ejection head shown in FIG. 2(*a*), at a line A-A in FIG. 2(*a*).

Referring to FIG. 2, the liquid ejecting method employed in this embodiment is as follows: The liquid ejection head in accordance with the present invention comprises: an orifice plate 1 having a plurality of ejection orifices 2, and a plurality of liquid chambers 5 for storing liquid, and a plurality of liquid chamber volume controlling means 6 having a piezoelectric element. The plurality of liquid chambers 5 are connected to the plurality of ejection orifices 2 one for one. The plurality of liquid chamber volume controlling means 6 are disposed in the plurality of liquid chambers 5, one for one. As driving signals in accordance with recording data are applied to the liquid chamber volume controlling means 6 from a driver circuit (unshown), liquid droplets are ejected from the ejection orifices 2.

First, the method for measuring the exact time when the tip of the liquid column 3 emerges outward past the plane of the external surface 1*a* of the orifice plate 1, that is, the plane of the opening of the ejection orifice 2, as liquid is ejected with the use of the liquid ejecting method in accordance with the present invention, will be described.

Principally, the time when the tip of the liquid column 3 emerges outward past the plane of the external surface 1*a* of the orifice plate 1 can be detected with the use of a CCD camera or the like, by projecting a pulsing beam of light onto the ejection orifice 2 with the use of a strobe, an LED, a laser, or the like.

Figure 3:
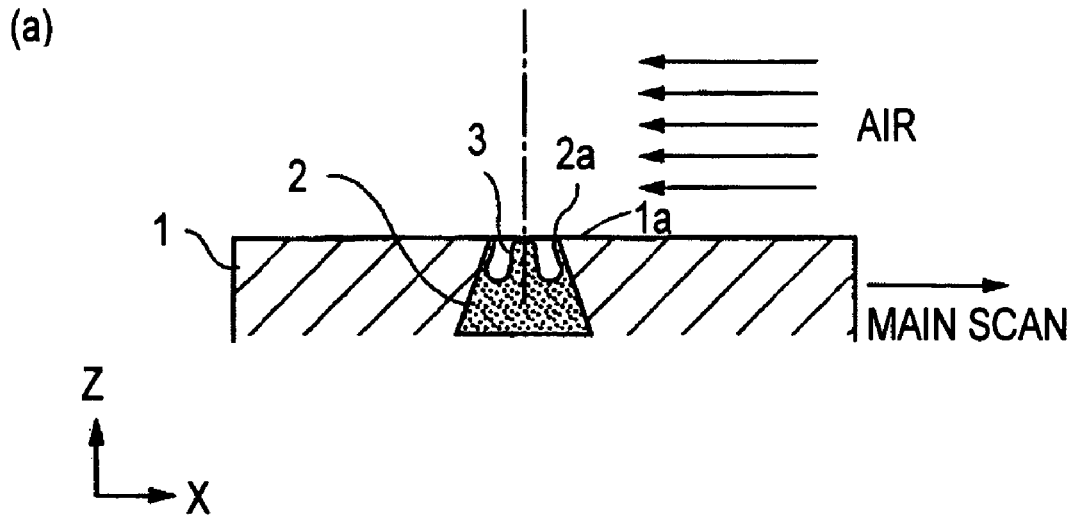
FIG. 3 is a schematic sectional view of one of the liquid ejection orifices and its adjacencies, showing how liquid is being ejected by the liquid ejecting method in accordance with the present invention.
Figure 3:
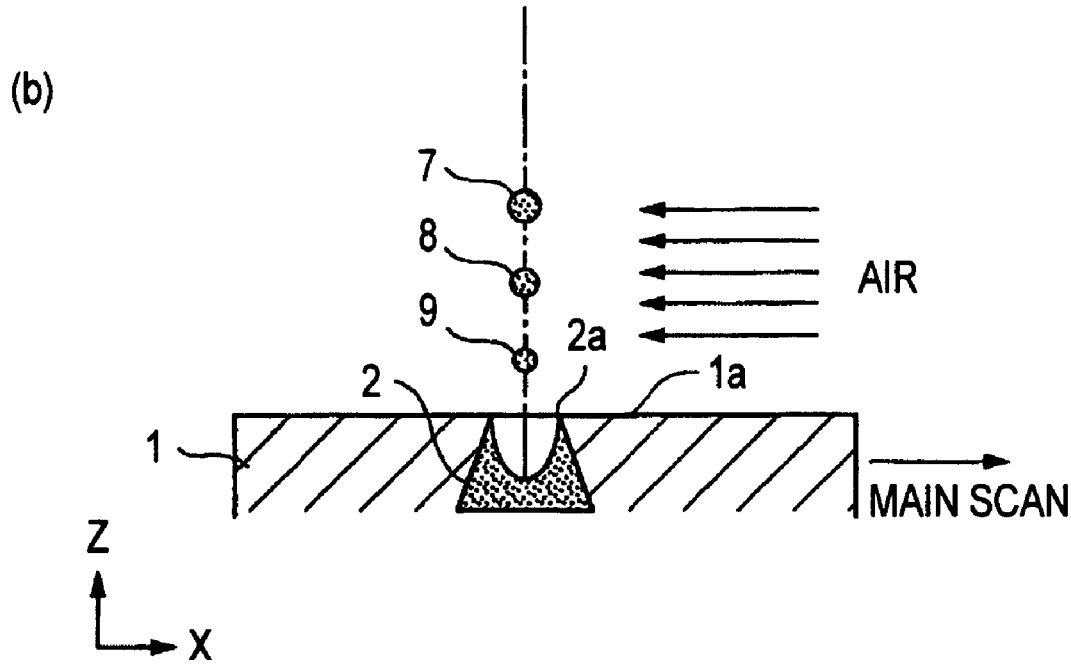
Figure 4:
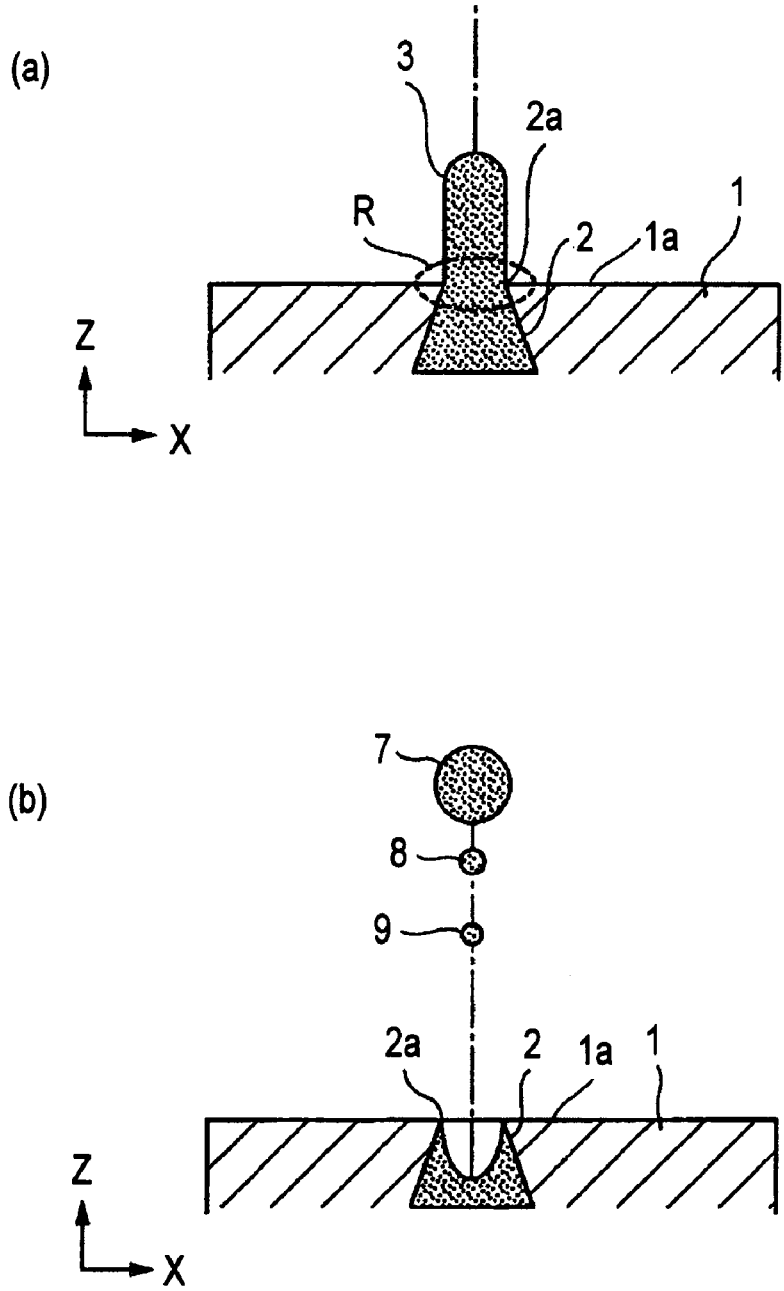
FIG. 4 is a schematic sectional view of one of the liquid ejection orifices and its adjacencies, showing how liquid is being ejected by the liquid ejecting method in accordance with the prior art.
Figure 5:
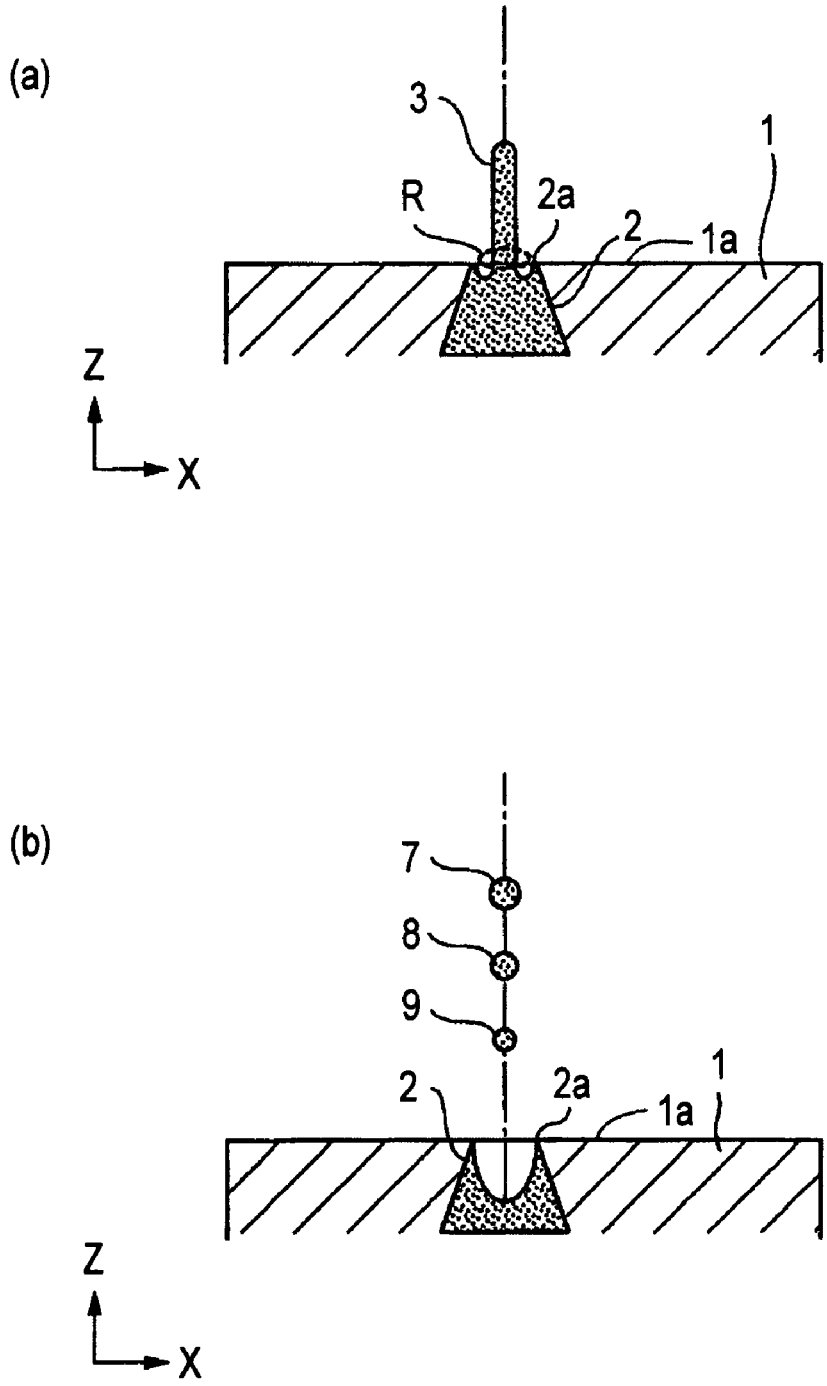
FIG. 5 is a schematic sectional view of one of the liquid ejection orifices and its adjacencies, showing how liquid is being ejected by the liquid ejecting method in accordance with the prior art.

FIGS. 3-5 are schematic sectional views of one of the liquid ejection orifices 2 and its adjacencies, showing, following the time line, how the liquid column 3 forms and turns into multiple droplets. It should be noted here that the number of the liquid droplets into which the liquid column 3 breaks, varies; it is not limited to the number in FIGS. 3-5.

Next, the method for measuring the time (t=t0) when the liquid chamber volume controlling means 6 begins expanding will be described. The time (t=t0) is detected by the use of a noncontact method for measuring the vibrations of an object with the use of an optical heterodyne method, which is one of the well-known technologies. With the use of this method, the speed of a vibration plate 4 is measured with the use of a laser trap vibrometer, with no contact. Then, the time (t=t0) when the liquid chamber volume controlling means 6 began to expand the liquid chamber can be determined from the amount of displacement obtained by integrating the detected speed with respect to time. The expansion start time (t=t0) of the liquid chamber volume controlling means 6 can also be measured by the combination of a laser trap vibrometer and a fringe count displacement meter.

Regarding the manner in which the liquid column 3 emerges, the liquid column 3 emerges, with its "R" portion remaining in contact with the edge 2*a* of the opening of the ejection orifice 2 as shown in FIG. 4(*a*), or with its "R" portion having no contact with the edge 2*a* of the opening of the ejection orifice 2 as shown in FIG. 5(*a*). In either case, at the time (t=ts>0) when the liquid column 3 emerges outward past the plane of the external surface 1*a* of the orifice plate 1, the liquid column 3 begins to be subjected to the air flow formed in the recording gap. After a certain length of time (t=tp>ts), the process of severing the liquid column 3 by expanding the liquid chamber 5 begins. Then, after a certain length of time (t=td>tp), the liquid column 3 severs from the body of liquid in the liquid ejection nozzle and flies away while breaking into a plurality of liquid droplets, which continue to fly.

The process of liquid ejection in accordance with the liquid ejecting method in accordance with the present invention can be sequentially recorded in steps starting from the time (of electrical signal application) when the ejection begins, as shown in FIGS. 3-5. Then, the manner in which the liquid is ejected by the liquid ejecting method in accordance with the present invention can be confirmed by comparing the time (t=ts) when the liquid column 3 began to emerge past the plane of the external surface 1*a* of the orifice plate 1, and the time (t=tp) of the beginning of the expansion of the liquid chamber by the liquid chamber volume controlling means 6.

(Comparative Case 1)

A liquid ejection head similar to the one shown in FIG. 2 (which does not show common liquid chamber) was produced. The recording gap was 1.5 mm. Dots were formed on a coated paper of high quality by driving the representative nozzles at 15 kHz.

In this case, the time (t=tp) when the second expansion process by the liquid chamber volume controlling means 6 (unshown) began was after the time (t=ts) when the tip of the liquid column 3 began to emerge into the recording gap past the plane of the orifice plate 301 (FIG. 6) after the beginning of the first contraction process by the liquid chamber volume controlling means 6, which comes after the first expansion process by the liquid chamber volume controlling means 6.

Viewing in detail each dot on the coated paper of high quality revealed that each dot was formed of three liquid droplets which landed in a partially overlapping manner.

Figure 6:
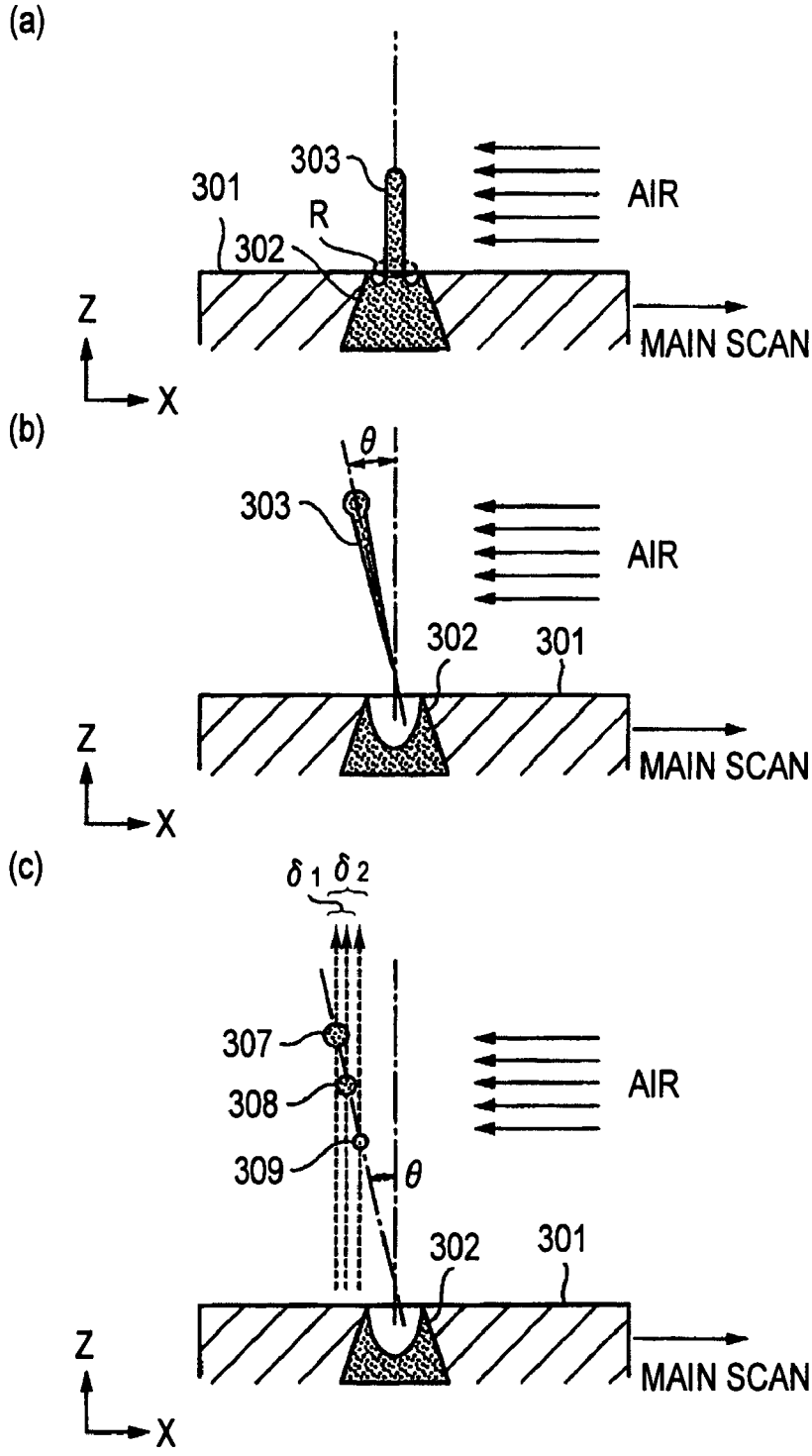
FIG. 6 is a schematic sectional view of one of the liquid ejection orifices and its adjacencies, showing how liquid is being ejected by the liquid ejecting method in accordance with the prior art.

To describe this phenomenon with reference to FIGS. 6(*a*)-6(*c*), the liquid ejection head glides in the primary scanning direction (X direction) as shown in FIG. 6(*a*), and therefore, the air in the recording gap flows, relative to the liquid ejection head, in the direction opposite to the X direction. Thus, it is reasonable to think that as the liquid column 3 projects by a certain length into the recording gap, it is tilted by an angle of è as shown in FIG. 6(*b*). However, the accurate value of the angle è could not be calculated from the images from the CCD camera.

Thereafter, the tilted liquid column 3 broke into three liquid droplets or so, in such a manner that in terms of the primary scanning direction, there were an initial distance of ä1 between the center of the primary droplet 307 and the first satellite droplet 308, an initial distance of ä2 between the primary droplet 307 and the second satellite droplet 309, and so on. Then, these liquid droplets flew while maintaining the above described distances, and landed. This is thought to be why each dot appeared as described above. Incidentally, in FIGS. 6(*b*) and 6(*c*), the angle è, and distances ä1 and ä2 among the droplets immediately after the breakage of the liquid column 3 into the plurality of droplets, are exaggerated for the description of the angle and distances.

Embodiment 1

Next, referring to FIG. 3, the first embodiment of the present invention will be described. The liquid ejection head in this embodiment is similar to the one shown in FIG. 2. In this embodiment, the recording gap was 1.5 mm, and dots were formed on a piece of coated paper of high quality by driving the representative nozzles at 15 kHz. The recording head was driven so that after the beginning of the first contraction process by the liquid chamber volume controlling means 6, which came after the first expansion process by the liquid chamber volume controlling means 6, the time (t=tp) of the beginning of the second expansion process by the liquid chamber volume controlling means 6 came before the time (t=ts) when the tip of the liquid column 3 began projecting past the plane of the external surface 1*a* of the orifice plate 1.

Viewing in detail each dot on the coated paper of high quality revealed that unlike the dots in the first comparative case, the dots formed by the recording head in this embodiment were almost perfectly circular, that is, so close to being perfectly circular that it was virtually impossible to detect that each dot was formed of a plurality of liquid droplets. The liquid ejection head glided in the primary scanning direction (X direction) as shown in FIG. 3, and therefore, the air in the recording gap flowed, relative to the liquid ejection head, in the direction opposite to the X direction. In this embodiment, however, the liquid column 3 projected into the recording gap by a distance substantially shorter than the distance by which the liquid column 3 projected in first comparative case. Thus, it is reasonable to think that this is why the angle of è (FIG. 6) by which the liquid column 3 was tilted in this embodiment was extremely small.

Embodiment 2

Next, referring to FIG. 3, the second embodiment of the present invention will be described. The liquid ejection head in this second embodiment is similar in structure to the one shown in FIG. 2. In this embodiment, however, the recording head was driven so that after the beginning of the first contraction process by the liquid chamber volume controlling means 6, which came after the first expansion process by the liquid chamber volume controlling means 6, the time (t=tp') of the beginning of the second expansion process by the liquid chamber volume controlling means 6 came before the time (t=ts) when the tip of the liquid column 3 began projecting past the plane of the external surface 1*a* of the orifice plate 1, and also, so that the time tp' came before the time tp in the first embodiment. The recording gap was 1.5 mm, and dots were formed on a piece of coated paper of high quality by driving the representative nozzles at 15 kHz, under the same conditions as those in the first embodiment.

Viewing in detail each dot on the coated paper of high quality revealed that the dots formed by the recording head in this embodiment were almost perfectly circular, that is, so close to being perfectly circular that it was virtually impossible to detect that each dot was formed of a plurality of liquid droplets, as those formed by the liquid ejection head in the first embodiment. The liquid ejection head glided in the primary scanning direction (X direction), and therefore, the air in the recording gap flowed, relative to the liquid ejection head, in the direction opposite to the X direction. In this embodiment, however, the liquid column 3 projected into the recording gap by a distance substantially shorter than the distance by which the liquid column 3 was projected in the first comparative case. Thus, it is reasonable to think that this is why the angle of è (FIG. 6) by which the liquid column 3 was tilted in this embodiment was extremely small.

Embodiment 3

Next, referring to FIG. 3, the third embodiment of the present invention will be described. The liquid ejection head in this third embodiment is similar in structure to that in the second embodiment. In this embodiment, however, the liquid ejection head was driven so that after the beginning of the first contraction process by the liquid chamber volume controlling means 6, which came after the first expansion process by the liquid chamber volume controlling means 6, the time (t=tp") of the beginning of the second expansion process by the liquid chamber volume controlling means 6 came before the time (t=ts) the tip of the liquid column 3 began projecting past the plane of the external surface 1*a* of the orifice plate 1 and also, so that the time tp" came before the time tp' in the second embodiment. The recording gap was 1.5 mm, and dots were formed on a piece of coated paper of high quality by driving the representative nozzles at 15 kHz, under the same conditions as those in the second embodiment.

Viewing in detail each dot on the coated paper of high quality revealed that the dots formed by the recording head in this embodiment were almost perfectly circular, that is, so close to being perfectly circular that it was virtually impossible to detect that each dot was formed of a plurality of liquid droplets, as those formed by the liquid ejection head in the first embodiment. The liquid ejection head glided in the primary scanning direction (X direction), and therefore, the air in the recording gap flowed, relative to the liquid ejection head, in the direction opposite to the X direction. In this embodiment, however, the liquid column 3 projected into the recording gap by a distance substantially shorter than the distance by which the liquid column 3 was projected in the first comparative case. Thus, it is reasonable to think that this is why the angle of è (FIG. 6) by which the liquid column 3 was tilted in this embodiment was extremely small.

Embodiment 4

Next, referring to FIG. 3, the fourth embodiment of the present invention will be described. In this embodiment, first, the auxiliary contraction process by the liquid chamber volume controlling means 6 is started. The auxiliary contraction process is a process in which each liquid chamber is contracted, reducing thereby its volume, by an amount insufficient for liquid ejection. To include this process in each ejection cycle has the drawback of prolonging each ejection cycle. However, it has the merit of increasing the distance by which the meniscus can be pulled back within the limited control range (sum of meniscus displacement by contraction process and meniscus displacement by expansion process) of the liquid chamber volume controlling means 6. The liquid ejection head in this embodiment was driven so that, first, the above described auxiliary contraction process was carried out, and then, after the beginning of the first contraction process by the liquid chamber volume controlling means 6, which came after the first expansion process by the liquid chamber volume controlling means 6, the time (t=tp) of the beginning of the second expansion process by the liquid chamber volume controlling means 6 came before the time (t=ts) when the tip of the liquid column 3 began projecting past the plane of the external surface 1*a* of the orifice plate 1 The recording gap was 1.5 mm, and dots were formed on a piece of coated paper of high quality by driving the representative nozzles at 15 kHz, under the same conditions as those in the first comparative case.

Viewing in detail each dot on the coated paper of high quality revealed that unlike the dots formed by the liquid ejection in the first comparative case, the dots formed by the liquid ejection head in this embodiment were almost perfectly circular, that is, so close to being perfectly circular that it was virtually impossible to detect that each dot was formed of a plurality of liquid droplets. The liquid ejection head glided in the primary scanning direction (X direction), and therefore, the air in the recording gap flew, relative to the liquid ejection head, in the direction opposite to the X direction. In this embodiment, however, the liquid column 3 projected into the recording gap by a distance substantially shorter than the distance by which the liquid column 3 projected in the first comparative case. Thus, it is reasonable to think that this is why the angle of è (FIG. 6) by which the liquid column 3 was tilted in this embodiment was extremely small.

(Comparative Case 2)

A liquid ejection head smaller in ejection orifice diameter than the one in the above described first comparative case (common liquid chamber is not shown) was produced. The recording gap was 1.5 mm. Dots were formed on a coated paper of high quality by driving the representative nozzles at 15 kHz.

Viewing in detail each dot on the coated paper of high quality revealed that each dot was formed of a minimum of three liquid droplets which landed in a partially overlapping manner. In this case, the liquid ejection head was driven so that after the beginning of the first contraction process by the liquid chamber volume controlling means 6 which came after the first expansion process by the liquid chamber volume controlling means 6, the time (t=tp) when the second expansion process by the liquid chamber volume controlling means 6 (unshown) began was later than the time (t=ts) when the tip of the liquid column 303 began to emerge into the recording gap past the plane of the external surface of the orifice plate of the orifice plate 301 (FIG. 6).

To describe this phenomenon with reference to FIG. 6, the liquid ejection head glided in the primary scanning direction (X direction) as shown in FIG. 6, and therefore, the air in the recording gap flowed, relative to the liquid ejection head, in the direction opposite to the X direction. Thus, it is reasonable to think that as the liquid column 303 projected by a certain length into the recording gap, it was tilted by an angle of è as shown in FIG. 6(*b*). However, the accurate value of the angle è could not be calculated from the images from the CCD camera.

Thereafter, the tilted liquid column 303 broke into three liquid droplets or so, in such a manner that in terms of the primary scanning direction, there were an initial distance of ä1 between the center of the primary droplet 307 and that of the first satellite droplet 308, an initial distance of ä2 between the center of the primary droplet 307 and that of the second satellite droplet 309, and so on. Then, these liquid droplets flew while maintaining the above described distances, and landed on the coated paper. This is thought to be why each dots appeared as described above.

Embodiment 5

Next, referring to FIG. 3, the fifth embodiment of the present invention will be described. The liquid ejection head in this fifth embodiment is similar in structure to the one the second embodiment. In this embodiment, however, the liquid ejection head was driven so that after the beginning of the first contraction process by the liquid chamber volume controlling means 6, which came after the first expansion process by the liquid chamber volume controlling means 6, the time (t=tp) of the beginning of the second expansion process by the liquid chamber volume controlling means 6 came before the time (t=ts) when the tip of the liquid column 3 began projecting into the recording gap past the plane of the external surface 1*a* of the orifice plate 1. The recording gap was 1.5 mm, and dots were formed on a piece of coated paper of high quality by driving the representative nozzles at 15 kHz, under the same conditions as those under which the liquid ejection head in the second comparative case was driven.

Viewing in detail each dot on the coated paper of high quality revealed that unlike the dots formed by the liquid ejection head in second comparative case, the dots formed by the recording head in this embodiment were almost perfectly circular, that is, so close to being perfectly circular that it was virtually impossible to detect that each dot was formed of a plurality of liquid droplets. The liquid ejection head glided in the primary scanning direction (X direction), and therefore, the air in the recording gap flowed, relative to the liquid ejection head, in the direction opposite to the X direction. In this embodiment, however, the liquid column 3 projected into the recording gap by a distance substantially shorter than the distance by which the liquid column 3 projected from the liquid ejection head in the second comparative case. Thus, this is though to be why the angle of è (FIG. 6) by which the liquid column 3 was tilted in this embodiment was extremely small.

Embodiment 6

Next, referring to FIG. 3, the sixth embodiment of the present invention will be described. The liquid ejection head in this sixth embodiment is the same in structure as that in the fifth embodiment. This liquid ejection head, however, was driven so that after the beginning of the first contraction process by the liquid chamber volume controlling means 6, which came after the first expansion process by the liquid chamber volume controlling means 6, the time (t=tp') of the beginning of the second expansion process by the liquid chamber volume controlling means 6 came before the time (t=ts) when the tip of the liquid column 3 began projecting into the recording gap past the plane of the external surface 1*a* of the orifice plate 1 and also, so that the time tp' came before the time tp in the fifth embodiment. The recording gap was 1.5 mm, and dots were formed on a piece of coated paper of high quality by driving the representative nozzles at 15 kHz, under the same conditions as those in the first embodiment.

Viewing in detail each dot on the coated paper of high quality revealed that the dots formed by the recording head in this embodiment were almost perfectly circular, that is, so close to being perfectly circular that it was virtually impossible to detect that each dot was formed of a plurality of liquid droplets, as those formed by the liquid ejection head in the fifth embodiment. The liquid ejection head glided in the primary scanning direction (X direction), and therefore, the air in the recording gap flowed, relative to the liquid ejection head, in the direction opposite to the X direction. In this embodiment, however, the liquid column 3 projected into the recording gap by a distance substantially shorter than the distance by which the liquid column 303 was extruded by the liquid ejection head in the second comparative case. Thus, it is reasonable to think that this is why the angle of è (FIG. 6) by which the liquid column 3 was tilted in this embodiment was extremely small.

Embodiment 7

Next, referring to FIG. 3, the seventh embodiment of the present invention will be described. The liquid ejection head in this seventh embodiment is the same in structure as that in the sixth embodiment. This liquid ejection head, however, was driven so that after the beginning of the first contraction process by the liquid chamber volume controlling means 6, which came after the first expansion process by the liquid chamber volume controlling means 6, the time (t=tp") of the beginning of the second expansion process by the liquid chamber volume controlling means 6 came before the time (t=ts) when the tip of the liquid column 3 began projecting into the recording gap past the plane of the external surface 1*a* of the orifice plate 1 and also, so that the time tp" came before the time tp' in the sixth embodiment. The recording gap was 1.5 mm, and dots were formed on a piece of coated paper of high quality by driving the representative nozzles at 15 kHz, under the same conditions as those in the second embodiment.

Viewing in detail each dot on the coated paper of high quality revealed that the dots formed by the recording head in this embodiment were almost perfectly circular, that is, so close to being perfectly circular that it was virtually impossible to detect that each dot was formed of a plurality of liquid droplets, as those formed by the liquid ejection head in the sixth embodiment. The liquid ejection head glided in the primary scanning direction (X direction), and therefore, the air in the recording gap flowed, relative to the liquid ejection head, in the direction opposite to the X direction. In this embodiment, however, the liquid column 3 was extruded into the recording gap by a distance substantially shorter than the distance by which the liquid column 303 was extruded by the liquid ejection head in the second comparative case. Thus, it is reasonable to think that this is why the angle of è (FIG. 6) by which the liquid column 3 was tilted in this embodiment was extremely small.

Embodiment 8

Next, referring to FIG. 3, the eighth embodiment of the present invention will be described. The liquid ejection head in the eighth embodiment was the same in structure as the second comparative sample of a liquid ejection head. In this embodiment, however, first, the auxiliary contraction process by the liquid chamber volume controlling means 6 was started. The auxiliary contraction process is a process in which each liquid chamber is contracted, reducing thereby its volume, by an amount insufficient for liquid ejection. To include this process in each ejection cycle has the drawback of prolonging each ejection cycle. However, it has the merit of increasing the distance by which the meniscus can be pulled back as far as possible within the limited control range (sum of meniscus displacement by contraction process and meniscus displacement by expansion process) of the liquid chamber volume controlling means 6 (control range of meniscus is expanded). The liquid ejection head in this embodiment was driven so that first, the above described preliminary contraction process, and then, after the beginning of the first contraction process by the liquid chamber volume controlling means 6, which came after the first expansion process by the liquid chamber volume controlling means 6, the time (t=tp) of the beginning of the second expansion process by the liquid chamber volume controlling means 6 came before the time (t=ts) when the tip of the liquid column 3 began projecting past the plane of the external surface 1*a* of the orifice plate 1. The recording gap was 1.5 mm, and dots were formed on a piece of coated paper of high quality by driving the representative nozzles at 15 kHz, under the same conditions as those under which the liquid ejection head in the first comparative case was driven.

Viewing in detail each dot on the coated paper of high quality revealed that unlike the dots formed by the liquid ejection head in the second comparative case, the dots formed by the liquid ejection head in this embodiment were almost perfectly circular, that is, so close to being perfectly circular that it was virtually impossible to detect that each dot was formed of a plurality of liquid droplets. The liquid ejection head glided in the primary scanning direction (X direction), and therefore, the air in the recording gap flew, relative to the liquid ejection head, in the direction opposite to the X direction. In this embodiment, however, the liquid column 3 was extruded into the recording gap by a distance substantially shorter than the distance by which the liquid column 303 was extruded by the liquid ejection head in the second comparative embodiment. This is thought to be why the angle of θ (FIG. 6) by which the liquid column 3 was tilted was extremely small.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 415868/2003 filed Dec. 15, 2003, which is hereby incorporated by reference.

What is claimed is:

1. A liquid ejecting method for ejecting liquid from a liquid ejecting head, the liquid ejecting head including a liquid chamber for storing liquid to be ejected, an ejection outlet in fluid communication with the liquid chamber, liquid chamber volume control means for changing a volume of the liquid chamber, and an outer surface through which the ejection outlet opens, wherein each ejection period, in which the liquid is ejected through the ejection outlet, comprises:

a first expansion step of expanding a volume of the liquid chamber;

a contraction step of reducing the volume of the liquid chamber after said first expansion step; and a second expansion step of expanding, after a column of the liquid is formed in the ejection outlet by said contraction step, the volume of the liquid chamber before a tip of the column of the liquid projects outside beyond the outer surface.

2. A method according to claim 1, further comprising an additional contraction step of reducing the volume of the liquid chamber to such an extent that liquid is not ejected.

3. A method according to claim 1, wherein the liquid chamber volume control means comprises a piezoelectric element.

4. A liquid ejecting apparatus including a liquid ejecting head, the liquid ejecting head including a liquid chamber for storing liquid to be ejected, an ejection outlet in fluid communication with the liquid chamber, liquid chamber volume controlling and changing means for changing a volume of the liquid chamber, and an outer surface through which the ejection outlet opens, said liquid ejecting apparatus comprising:

a driving circuit for applying, to the liquid chamber volume controlling and changing means, a signal for, in an ejection period in which the liquid is ejected through the ejection outlet, expanding the volume of the liquid chamber, and then, reducing the volume of the liquid chamber, and expanding, after a column of the liquid is formed in the ejection outlet by the reduction, the volume of the liquid chamber before a tip of the column of the liquid projects outside beyond the outer surface.

5. An apparatus according to claim 4, wherein the liquid chamber volume controlling and changing means comprises a piezoelectric element.

6. A method according to claim 2, wherein the liquid chamber volume control means comprises a piezoelectric element.

* * * * *

UNITED STATES PATENT AND TRADEMARK OFFICE

CERTIFICATE OF CORRECTION

PATENT NO. : 7,419,235 B2
APPLICATION NO. : 11/007295
DATED : September 2, 2008
INVENTOR(S) : Kitakami It is certified that error appears in the above-identified patent and that said Letters Patent is hereby corrected as shown below:

COLUMN 8:
Line 18, "plate 1" should read --plate 1.--.

COLUMN 9:
Line 19, "one" should read --one in--.
Line 48, "though" should read --thought--.

Signed and Sealed this

Tenth Day of March, 2009

JOHN DOLL
*Acting Director of the United States Patent and Trademark Office*